US006561770B2

(12) United States Patent
Okuda

(10) Patent No.: US 6,561,770 B2
(45) Date of Patent: May 13, 2003

(54) ENGINE WATER PUMP WITH TEMPERATURE RESPONSIVE DRIVE

(75) Inventor: Kazuma Okuda, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/866,871

(22) Filed: May 30, 2001

(65) Prior Publication Data

US 2002/0012593 A1 Jan. 31, 2002

(30) Foreign Application Priority Data

May 30, 2000 (JP) ..... 2000-159739

(51) Int. Cl.[7] ..... F04B 49/00; F04B 35/00; F04B 17/00

(52) U.S. Cl. ..... 417/223; 417/319; 417/364; 417/362

(58) Field of Search ..... 417/14, 15, 42, 417/142, 275, 362, 364, 223, 212, 214, 319

(56) References Cited

U.S. PATENT DOCUMENTS 3,272,188 A * 9/1966 Sabat ..... 123/41.11
4,086,987 A * 5/1978 Riley et al. ..... 192/58.68
4,238,016 A * 12/1980 Yoshida et al. ..... 192/110 B
4,269,295 A * 5/1981 Kish ..... 192/58.684
4,850,465 A * 7/1989 Ono ..... 192/58.682
4,960,191 A * 10/1990 Lambert et al. ..... 192/58.682

* cited by examiner

*Primary Examiner*—Charles G. Freay
*Assistant Examiner*—Timothy P. Solak
(74) *Attorney, Agent, or Firm*—Armstrong, Westerman & Hattorri, LLP

(57) ABSTRACT

A fluid coupling is provided between a pump shaft of a water pump and a water pump pulley and includes a liquid chamber formed inside housings and filled with a fluid, and a rotor fixed to the pump shaft and housed in the liquid chamber. When the housings connected to a crank pulley via an endless belt rotate, the rotor is dragged by the viscosity of the fluid and the pump shaft rotates. Since the fluid coupling has the property of decreasing the rate of increase in the output rotational speed of the fluid coupling as the input rotational speed increases, the required rotational speed of the water pump can be guaranteed when the rotational speed of the engine is low, and the water pump can be prevented from rotating excessively when the rotational speed of the engine is high.

4 Claims, 6 Drawing Sheets

EMBODIMENT

ENGINE WATER PUMP WITH TEMPERATURE RESPONSIVE DRIVE

BACKGROUND OF THE INVENTION

1. Technical Field to Which the Invention Pertains

The present invention relates to an engine water pump drive structure in which a crank pulley fixed to an engine crankshaft and a water pump pulley connected to the pump shaft of the water pump supported in an engine block are connected to each other via an endless belt.

2. Description of the Related Art

A water pump for circulating cooling water to an engine water jacket is driven by connecting a water pump pulley fixed to a pump shaft and a crank pulley fixed to a crankshaft via an endless belt. As is conventional, the rotational speed of the water pump changes in proportion to the rotational speed of the engine crankshaft.

When the rotational speed of the water pump changes in proportion to the rotational speed of the engine crankshaft, the rotational speed of the water pump decreases when the engine is operated at low speed, and the rotational speed of the water pump increases when the engine is operated at high speed. If the diameter of the water pump pulley is made small so that the required rotational speed of the water pump can be guaranteed when the engine is operated at low speed, the rotational speed of the water pump becomes excessive when the engine is operated at high speed, thereby causing an energy loss. If the diameter of the water pump pulley is made large in order to prevent this, not only is it impossible to guarantee that the required amount of cooling water will be circulated when the engine is operated at low speed, but also the water pump pulley projects out to the side of the engine block thereby resulting in an increase in the overall size of the engine.

Cutting off the connection between the water pump pulley and the pump shaft by placing an ON/OFF type magnetic clutch of the type used in an air conditioner compressor between the water pump and the pump shaft could be considered, but it is difficult to precisely control the rotational speed of the water pump by means of an ON/OFF type magnetic clutch.

SUMMARY OF THE INVENTION

The present invention has been carried out in view of the above-mentioned circumstances, and it is an object of the present invention to maintain an appropriate rotational speed for the water pump over a wide range of engine rotational speeds without increasing the size of the water pump pulley.

In order to achieve the above-mentioned object, in accordance with the disclosed invention, there is provided an engine water pump drive structure in which a crank pulley fixed to a crankshaft of an engine and a water pump pulley connected to a pump shaft of a water pump supported in an engine block are connected to each other via an endless belt, said drive structure comprising a fluid coupling provided between the pump shaft of the water pump and the water pump pulley, said fluid coupling including means for decreasing the rate of increase in the output rotational speed of the fluid coupling as the input rotational speed increases.

In accordance with the above-mentioned arrangement, since the fluid coupling provided between the pump shaft of the water pump and the water pump pulley has the property of decreasing the rate of increase in the output rotational speed of the fluid coupling as the input rotational speed increases, the required rotational speed of the water pump can be guaranteed when the rotational speed of the crankshaft is low, and the water pump can be prevented from rotating excessively when the rotational speed of the crankshaft is high. Moreover, since the diameter of the water pump pulley can be reduced and, in addition, the water pump can be prevented from rotating excessively when the crankshaft is rotating at high speed, the amount of overhang of the water pump pulley relative to the engine block can be decreased, thereby reducing the overall size of the engine.

The invention also provides an engine water pump drive structure including means for decreasing the amount of slip of the fluid coupling as the temperature of the air surrounding the engine rises.

In accordance with the above-mentioned arrangement, since the amount of slip of the fluid coupling decreases as the temperature of the air surrounding the engine rises, it is possible to effectively prevent the engine from overheating by rotating the water pump at high speed when the temperature of the engine is high.

Still further, there is provided an engine water pump drive structure wherein the fluid coupling comprises a liquid chamber and a liquid reservoir rotating integrally with the water pump pulley, a rotor housed in the liquid chamber and rotating integrally with the pump shaft, a communicating passage for providing communication between the outer end of the liquid chamber in the radial direction and the liquid reservoir, a valve hole formed in a partition separating the liquid chamber from the liquid reservoir, a control valve for opening and closing the valve hole, fan blades rotating integrally with the water pump pulley and taking in air, and a bimetal operating in response to the temperature of the air taken in by the fan blades so as to operate the control valve.

In accordance with the above-mentioned arrangement, when the temperature of the air surrounding the engine decreases, the bimetal deforms to close the control valve, so that communication between the liquid reservoir and the liquid chamber is blocked. As a result, even when the fluid inside the liquid chamber is discharged into the liquid reservoir by the pumping action of the rotor, since the fluid is not returned to the liquid chamber, the torque transmitted to the rotor decreases, the rotational speed of the pump shaft decreases, and the warm-up of the engine can thus be accelerated effectively. When the temperature of the air surrounding the engine increases, the bimetal deforms to open the control valve, so that communication is provided between the liquid reservoir and the liquid chamber. As a result, when the fluid inside the liquid chamber is discharged into the liquid reservoir by the pumping action of the rotor, since the fluid is returned to the liquid chamber, the transmission of torque to the rotor is ensured, the rotational speed of the pump shaft is maintained, and the occurrence of overheating can be effectively prevented.

BRIEF DESCRIPTION OF THE DRAWINGS

The practical modes of the present invention are described below with reference to embodiments of the present invention shown in the attached drawings.

FIGS. 4A and 4B are diagrams for explaining the action of the fluid coupling wherein FIG. 4A represents the present invention and FIG. 4B represents the prior art;

DETAILED DESCRIPTION OF THE PREFERRED EMBODIMENTS

FIGS. 1 to 4B show a first embodiment of the present invention.

Figure 1:
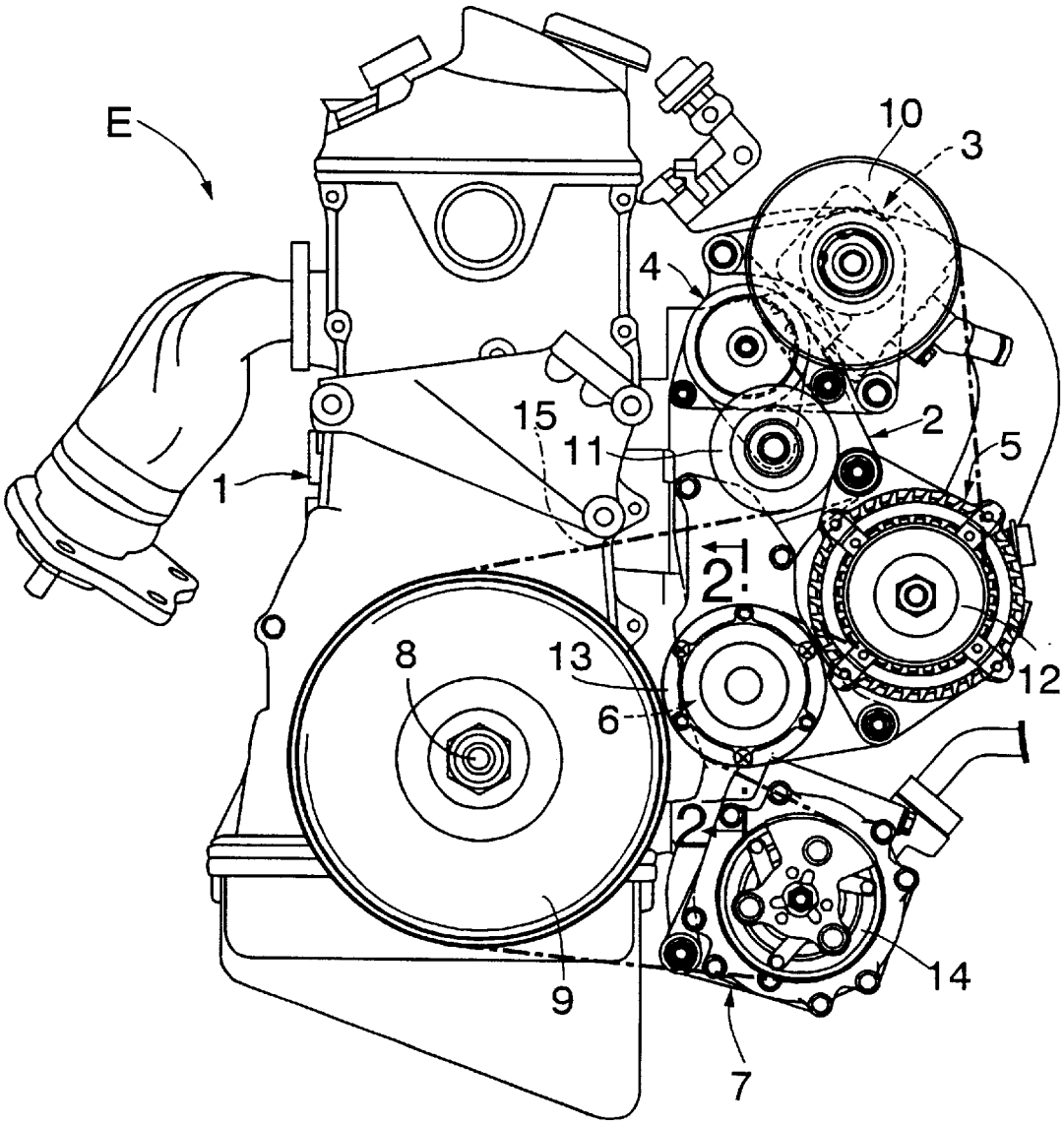
FIG. 1 is a view of an in-line multiple cylinder engine along the axial direction of its crankshaft.

As shown in FIG. 1, an accessory attachment bracket 2 is fixed to a side face of an engine block 1 of an in-line multiple cylinder engine E that is to be mounted in a vehicle. An oil pump 3 for power steering, an auto tensioner 4, an alternator 5, a water pump 6 for cooling the engine and a compressor 7 for air conditioning are fixed to the accessory attachment bracket 2. A single endless belt 15 is wrapped around a crank pulley 9 provided on a shaft end of a crankshaft 8 of the engine E (the shaft end on the side opposite to the transmission), an oil pump pulley 10 provided on the oil pump 3, a tensioner pulley 11 provided on the auto tensioner 4, an alternator pulley 12 provided on the alternator 5, a water pump pulley 13 provided on the water pump 6 and a compressor pulley 14 provided on the compressor 7. The driving force of the crankshaft 8 is transmitted to the oil pump 3, the alternator 5, the water pump 6 and the compressor 7 via the endless belt 15 and tension is applied to the endless belt 15 by the auto tensioner 4.

The tensioner pulley 11 and the water pump pulley 13 are driven along the back surface of the endless belt 15. By employing the single endless belt 15 and using the back surface thereof, not only can the accessories 3 to 7 be placed close to one another in a compact manner but also the accessories 3 to 7 can be reliably driven while ensuring that the endless belt 15 has a sufficient wrap angle around each of the pulleys 10 to 14.

Figure 2:
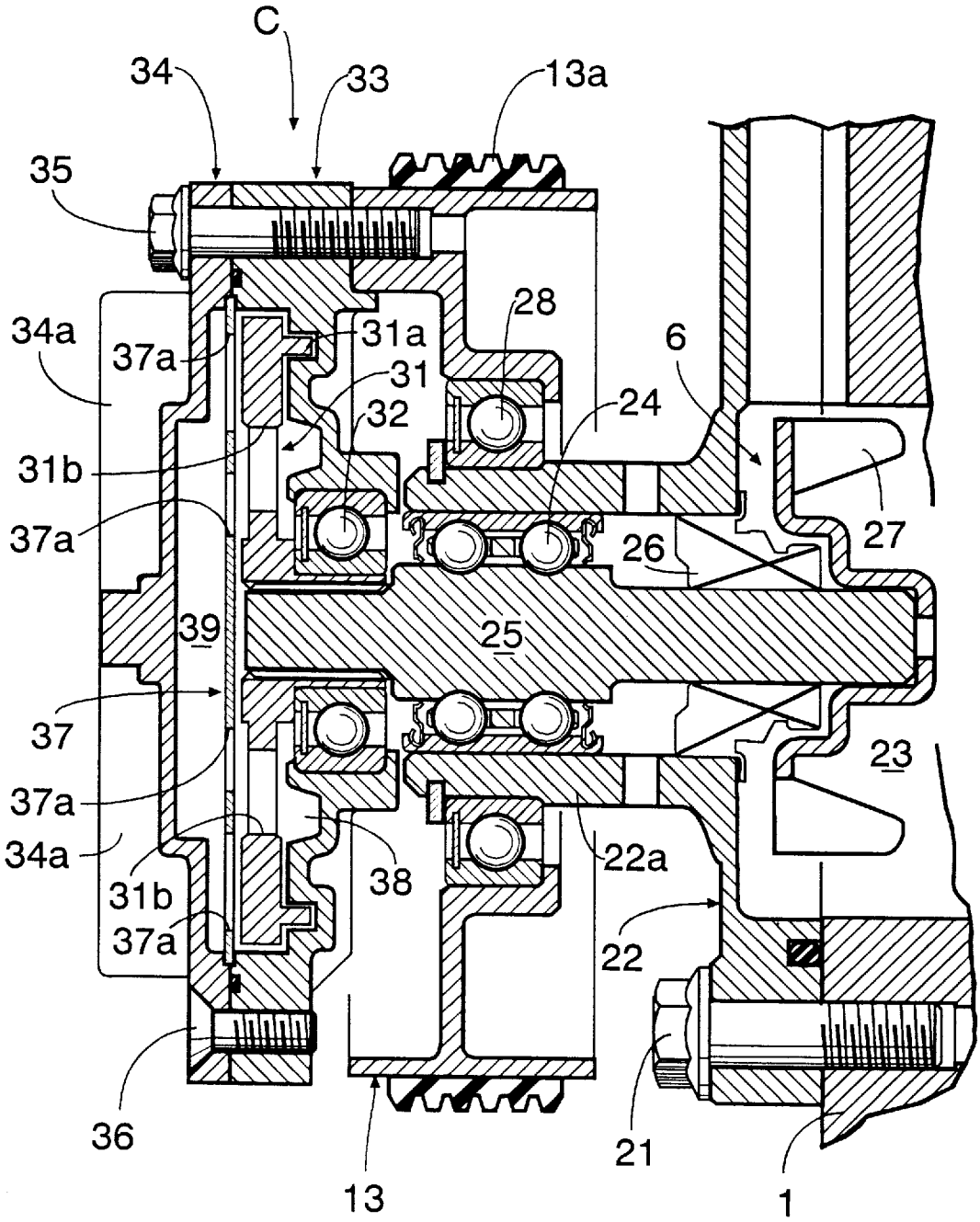
FIG. 2 is an enlarged cross-sectional view taken along line 2—2 in FIG. 1.

As is clear from FIG. 2, the water pump 6 for cooling the engine includes a pump cover 22 fixed to a wall of the engine block 1 by means of bolts 21, and a pump chamber 23 is formed inside the pump cover 22. A pump shaft 25 is rotatably supported via a ball bearing 24 by a cylindrical bearing section 22*a* provided in the pump cover 22, and an impeller 27 is attached to the shaft end of the pump shaft 25 extending inside the pump chamber 23 through a sealing member 26.

The water pump pulley 13 is rotatably supported on the outer periphery of the bearing section 22*a* of the pump cover 22 via a ball bearing 28. A pulley channel 13*a* on the outer periphery of the water pump pulley 13 is molded with a resin, and engaged with the endless belt 15. The shaft end of the pump shaft 25 projecting out of the bearing section 22*a* of the pump cover 22 is connected to the water pump pulley 13 by means of a fluid coupling C.

The fluid coupling C comprises a disc-shaped rotor 31 spline-connected to the shaft end of the pump shaft 25, and a first housing 33 supported on the outer periphery of a boss of the rotor 31 via a ball bearing 32 and a second housing 34 superimposed on the outside of the first housing 33 in the axial direction. Both housings are tightened to the water pump pulley 13 by means of bolts 35, and are tightened together by means of screws 36. A plurality of heat-releasing fins 34*a* extend radially on the outside face of the second housing 34 in order to cool the fluid coupling C which has an increased temperature due to the frictional heat caused by agitation of the fluid.

A partition 37 interposed between the joining faces of the first housing 33 and the second housing 34 divides a liquid chamber 38 housing the rotor 31 from a liquid reservoir 39, and through holes 37*a* formed in the partition 37 provide communication between the liquid reservoir 39 and the liquid chamber 38. The liquid chamber 38 and the liquid reservoir 39 are filled with a viscous fluid (for example, a silicone oil) which functions as a medium for transmitting torque. An annular projection 31*a* and holes 31*b* are formed in the rotor 31 in order to increase the contact area with the fluid.

When the water pump pulley 13 connected via the endless belt 15 to the crank pulley 9 provided on the crankshaft 8 rotates, the first housing 33 and the second housing 34 of the fluid coupling C integrally attached to the water pump pulley 13 rotate, and the viscous fluid filled in the liquid chamber 38 is rotated by them. As a result, the rotor 31 housed inside the liquid chamber 38 is dragged by the viscous fluid and made to rotate. The rotation of the water pump pulley 13 is thus transmitted to the pump shaft 25 so as to operate the water pump 6, and cooling water circulates inside the water jacket (not illustrated) thereby cooling the high temperature part of the engine E.

Figure 3:
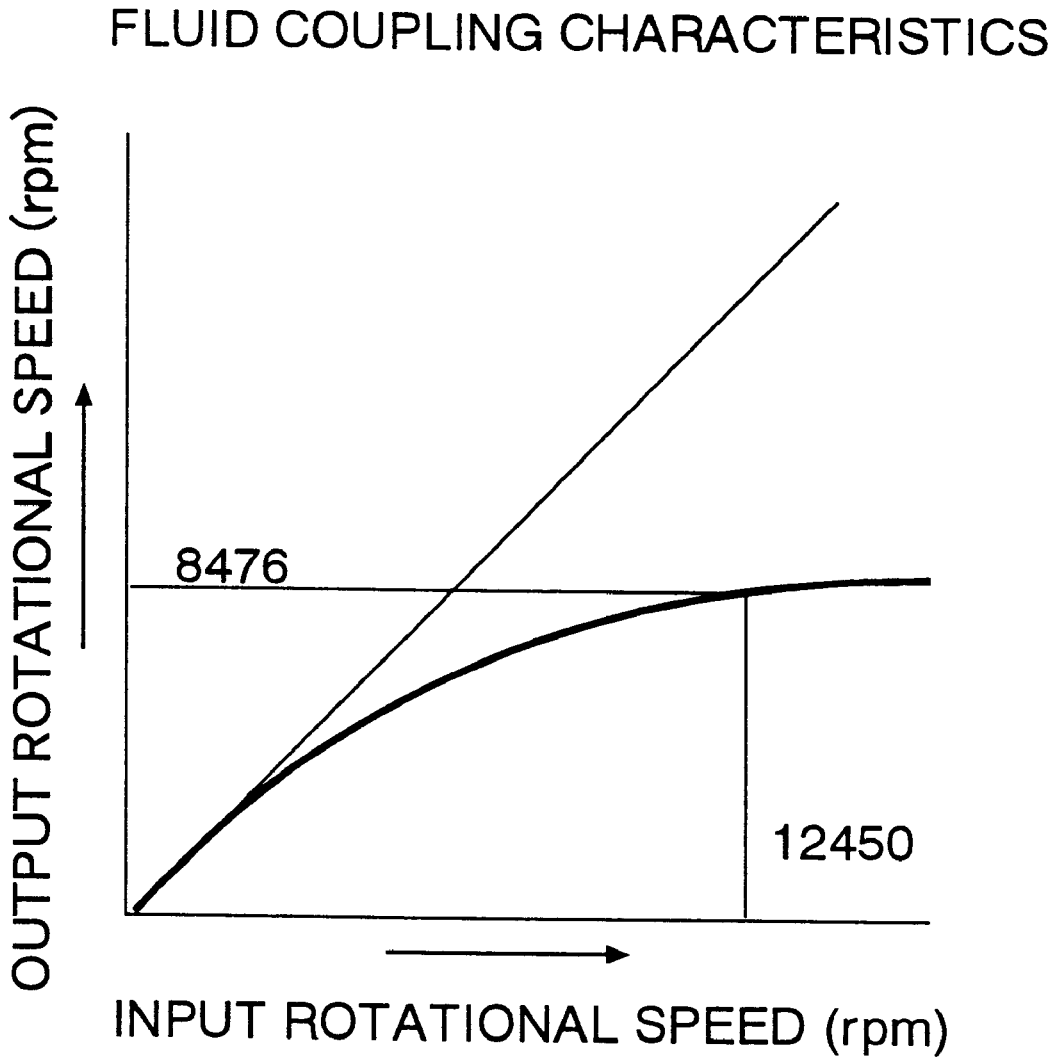
FIG. 3 is a graph showing the characteristics of output rotational speed with respect to an input rotational speed for a fluid coupling.
Figure 4A:
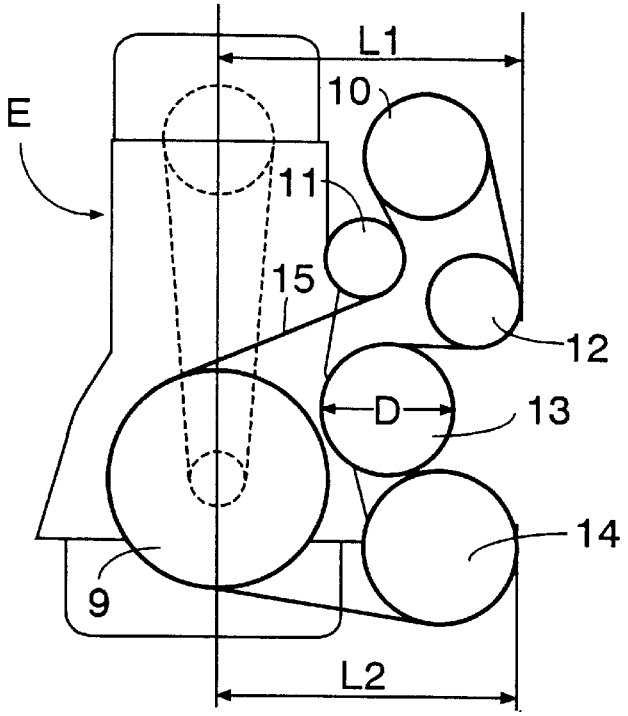
Figure 4B:
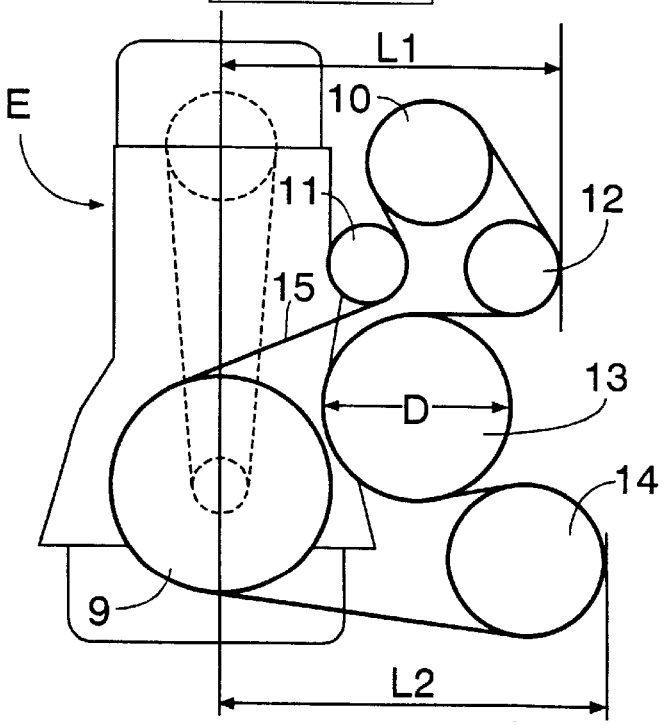
FIG.4B PRIOR ART

FIG. 3 is a graph showing the relationship between input rotational speed (rotational speed of the water pump pulley 13) and output rotational speed (rotational speed of the pump shaft 25) for the fluid coupling C. As shown, the output rotational speed more or less coincides with the input rotational speed in the region where the input rotational speed is low, but the rate of increase in the output rotational speed gradually decreases as the input rotational speed increases and finally converges to an upper limit.

Since the fluid coupling C is thus presented between the water pump pulley 13 and the pump shaft 25, when the engine E is operated at low speed the amount of slip of the fluid coupling C reduces thereby ensuring that the water pump 6 rotates at the required speed and, when the engine E is operated at high speed, the amount of slip of the fluid coupling C increases thereby preventing the water pump 6 from rotating at an excessive speed. Moreover, since the diameter D of the water pump pulley 13 can be reduced, the amount by which the water pump pulley 13 overhangs to the side of the engine block 1 can be reduced, and accompanying this, amounts of overhang L1 and L2 to the sides of the alternator pulley 12 and the compressor pulley 14 respectively can be decreased thus reducing the overall size of the engine E (see FIG. 4A).

Figure 5:
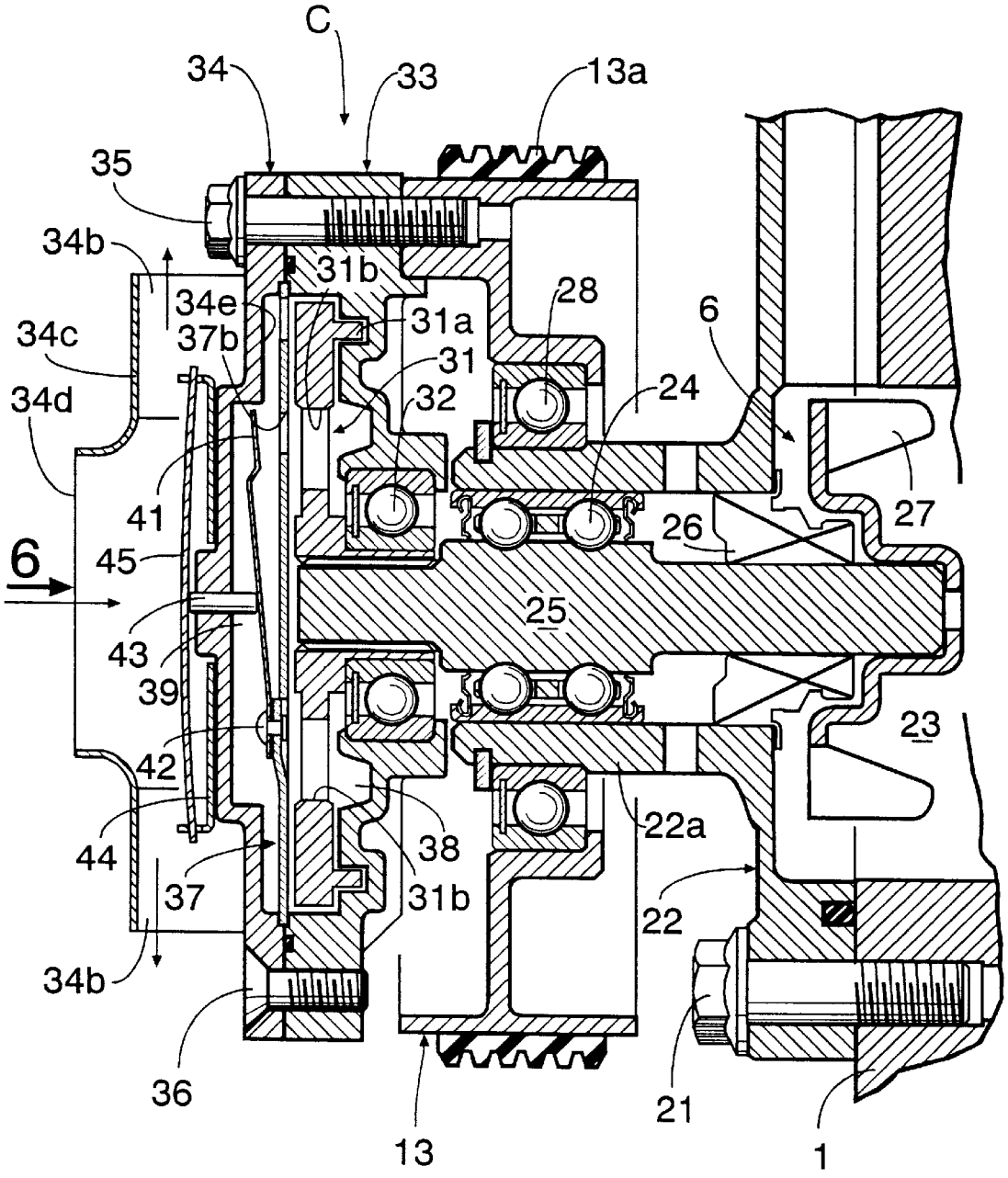
FIG. 5 is a view corresponding to FIG. 2 and illustrating a second embodiment of the invention.
Figure 6:
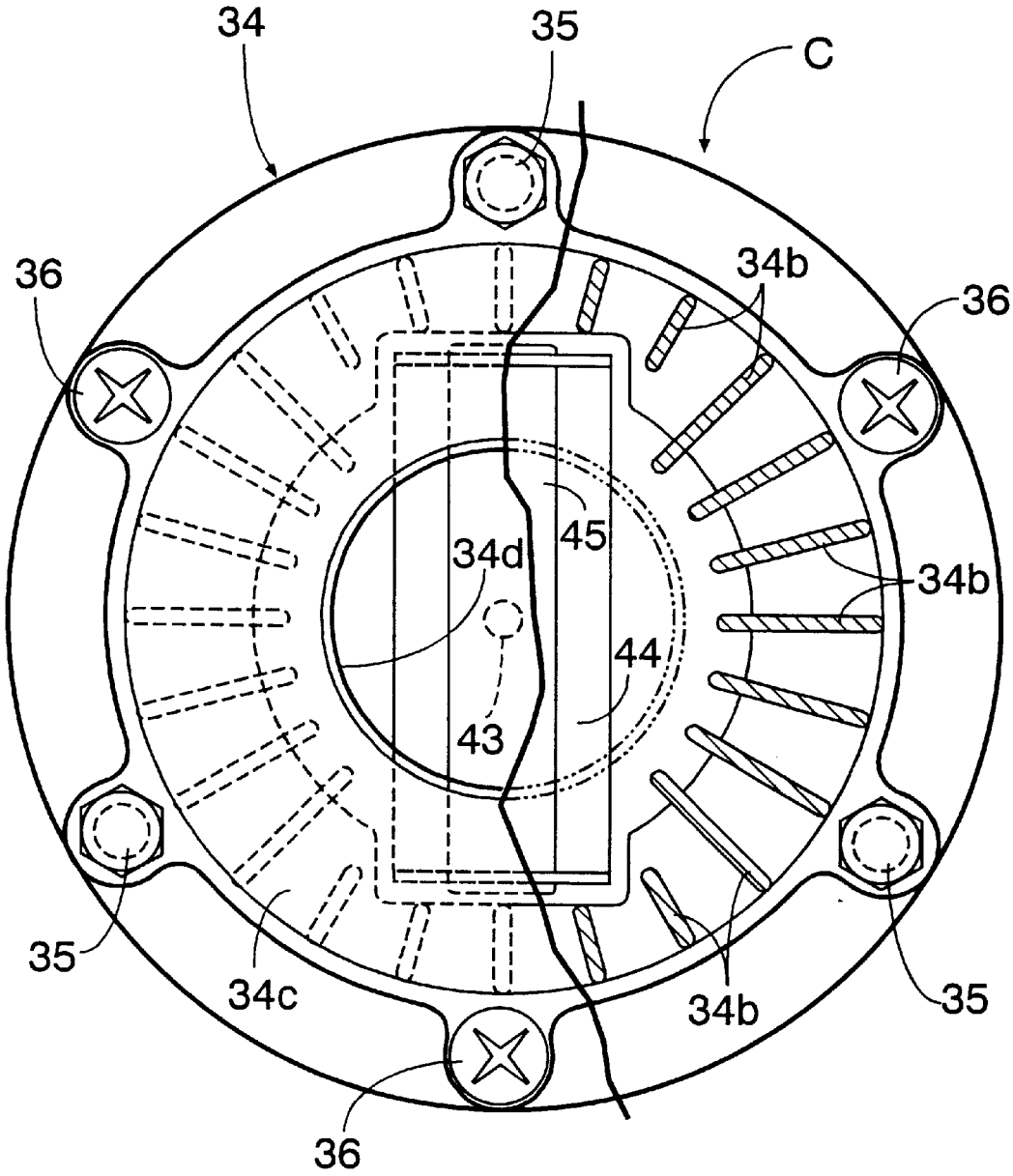
FIG. 6 is a view taken in the direction of the arrow in FIG. 5.

A second embodiment of the present invention is now explained by reference to FIGS. 5 and 6.

In the second embodiment of the invention, the amount of slip of the fluid coupling C is made to vary according to the atmospheric temperature. One end of a control valve 41 is fixed to the partition 37 of the fluid coupling C by means of a rivet 42, and the other end of the control valve 41 faces a valve hole 37*b* formed in the partition 37. One end of a rod 43 running in a slidable manner through the center of the second housing 34 is in contact with the outer surface of the control valve 41, and the other end thereof is in contact with the central area of a bimetal 45, the two ends of the bimetal 45 being supported by a bimetal holder 44 provided on the second housing 34. Centrifugal fan blades 34*b*, functioning also as heat-releasing fins, are radially formed on the outer periphery of the second housing 34 and the fan blades 34*b* are shielded with a cover 34*c* from outside. A circular air inlet 34*d* is formed in the center of the cover 34*c*, and the bimetal 45 faces the air inlet 34*d*. The outer end of the liquid chamber 38 in the radial direction communicates with the liquid reservoir 39 via a communicating passage 34*e*. The liquid chamber 38 and the liquid reservoir 39 are not completely filled with fluid so that the fluid can move between the liquid chamber 38 and the liquid reservoir 39.

When the fluid coupling C rotates together with the water pump pulley 13, the air taken in through the air inlet 34*d* by the fan blades 34*b* comes into contact with the bimetal 45. When the temperature of the air in the vicinity of the engine E is low, the bimetal 45 spreads straight to urge the rod 43, so that the tip of the control valve 41 is caused to block the valve hole 37*b* of the partition 37. As a result, when the fluid inside the liquid chamber 38 is discharged to the liquid reservoir 39 via the communicating passage 34*e* by the pumping action arising from the relative rotation between the rotor 31 and the liquid chamber 38, it becomes more difficult for the fluid inside the liquid reservoir 39 to return to the liquid chamber 38 via the valve hole 37*b*. Thus, the torque transmitted from the first housing 33 and the second housing 34 to the rotor 31 via the fluid decreases and the rotational speed of the water pump 6 decreases thereby accelerating the warm-up of the engine E.

On the other hand, when the temperature of the air in the vicinity of the engine E is high, the bimetal 45 curves into the form of an arc to release the pressure applied to the rod 43, so that the resilient force of the control valve 41 is caused to unblock the valve hole 37*b* of the partition 37. As a result, when the fluid inside the liquid chamber 38 is discharged into the liquid reservoir 39 via the communicating passage 34*e* by the pumping action arising from the relative rotation between the rotor 31 and the liquid chamber 38, since the fluid inside the liquid reservoir 39 is returned to the liquid chamber 38 through the valve hole 37*b*, the torque transmitted from the first housing 33 and the second housing 34 to the rotor 31 via the fluid increases and the rotational speed of the water pump 6 increases thereby preventing the engine E from overheating.

Since the amount of slip of the fluid coupling C changes according to the temperature of the air in the vicinity of the engine E, the rotational speed of the water pump 6 can be automatically increased and decreased thereby appropriately maintaining the temperature of the engine E.

Embodiments of the present invention have been described in detail above, but the present invention can be modified in a variety of ways without departing from the spirit and scope of the invention.

For example, in the present embodiments, a fluid coupling C using a silicone oil is illustrated, but the present invention can employ any other type of fluid coupling.

It will be appreciated further that, as hereinbefore described, in accordance with the first feature of the disclosed invention, since the fluid coupling provided between the pump shaft of the water pump and the water pump pulley has the property of decreasing the rate of increase in the torque transmitted as the rotational speed of the crankshaft increases, the required rotational speed of the water pump can be guaranteed when the rotational speed of the crankshaft is low, and the water pump can be prevented from rotating excessively when the rotational speed of the crankshaft is high. Moreover, since the diameter of the water pump pulley can be reduced and, in addition, the water pump can be prevented from rotating excessively when the crankshaft is rotating at high speed, the amount of overhang of the water pump pulley relative to the engine block can be decreased thereby reducing the overall size of the engine.

Also, according to the second feature of the present invention, since the amount of slip of the fluid coupling decreases as the temperature of the air surrounding the engine rises, when the temperature of the engine is high it is possible to effectively prevent the engine from overheating by rotating the water pump at high speed.

Moreover, according to the third feature of the present invention, when the temperature of the air surrounding the engine decreases, the bimetal deforms to close the control valve, so that communication between the liquid reservoir and the liquid chamber is blocked. As a result, even when the fluid inside the liquid chamber is discharged into the liquid reservoir by the pumping action of the rotor, since the fluid is not returned to the liquid chamber, the torque transmitted to the rotor decreases, the rotational speed of the pump shaft decreases, and the warm-up of the engine can thus be accelerated effectively. When the temperature of air surrounding the engine increases, the bimetal deforms to open the control valve, so that communication is provided between the liquid reservoir and the liquid chamber. As a result, when the fluid inside the liquid chamber is discharged into the liquid reservoir by the pumping action of the rotor, since the fluid is returned to the liquid chamber, the transmission of torque to the rotor is ensured, the rotational speed of the pump shaft is maintained, and an occurrence of overheating can be effectively prevented.

What is claimed is:

1. An engine water pump drive structure in which a crank pulley fixed to a crankshaft of an engine and a water pump pulley connected to a pump shaft of a water pump supported in an engine block are connected to each other via an endless belt, the water pump having a pump cover fixed to the engine block for rotatably carrying the pump shaft thereon, said drive structure comprising:

a fluid coupling provided between the pump shaft of the water pump and water pump pulley, said fluid coupling including a housing and means in the housing for slowing down the rate of increase in the output rotational speed of the fluid coupling as the input rotational speed increases, wherein the water pump pulley is coupled to the housing and carried rotatably on an outer periphery of the pump cover.

2. An engine water pump drive structure according to claim 1 including means for decreasing the amount of slip of the fluid coupling as the temperature of the air surrounding the engine rises.

3. An engine water pump drive structure according to claim 1, wherein the housing is formed of first and second members, and the water pump pulley, as well as the first and second members of the housing, are coupled together by common fastening means at outer peripheral portions thereof.

4. An engine water pump drive structure in which a crank pulley fixed to a crankshaft of an engine and a water pump pulley connected to a pump shaft of a water pump supported in an engine block are connected to each other via an endless belt, said drive structure comprising:

a fluid coupling provided between the pump shaft of the water pump and the water pump pulley, said fluid coupling including means for decreasing the rate of increase in the output rotational speed of the fluid coupling as the input rotational speed increases, and means for decreasing the amount of slip of the fluid coupling as the temperature of the air surrounding the engine rises, wherein the fluid coupling comprises a liquid chamber and a liquid reservoir rotating integrally with the water pump pulley; a rotor housed in the liquid chamber and rotating integrally with the pump shaft; a communicating passage providing communication between an outer end of the liquid chamber in the radial direction and the liquid reservoir; a valve hole formed in a partition separating the liquid chamber from the liquid reservoir; a control valve for opening and closing the valve hole; fan blades rotating integrally with the water pump pulley and being operative to take in air; and a bimetal associated with the control valve and operating in response to the temperature of the air taken in by the fan blades so as to control opening and closing operations of the control valve.

* * * * *